US012276220B2

(12) United States Patent
Ernst et al.

(10) Patent No.: US 12,276,220 B2
(45) Date of Patent: Apr. 15, 2025

(54) METHOD FOR HEATING AN EXHAUST SYSTEM

(71) Applicant: Robert Bosch GmbH, Stuttgart (DE)

(72) Inventors: Jonas Ernst, Stuttgart (DE); Michael Bachner, Stuttgart (DE); Tahir Harman, Tamm (DE); Thomas Zein, Sindelfingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 18/607,919

(22) Filed: Mar. 18, 2024

(65) Prior Publication Data

US 2024/0328334 A1 Oct. 3, 2024

(30) Foreign Application Priority Data

Mar. 20, 2023 (DE) ..... 102023202447.0

(51) Int. Cl.
*F01N 3/20* (2006.01)
*F01N 3/035* (2006.01)

(52) U.S. Cl.
CPC ..... *F01N 3/2013* (2013.01); *F01N 3/035* (2013.01); *F01N 2900/12* (2013.01); *F01N 2900/1402* (2013.01); *F01N 2900/1406* (2013.01); *F01N 2900/1411* (2013.01); *F01N 2900/1602* (2013.01); *F01N 2900/1631* (2013.01)

(58) Field of Classification Search
CPC .... F01N 3/2013; F01N 3/035; F01N 2900/12; F01N 2900/1402; F01N 2900/1406; F01N 2900/1411; F01N 2900/1602; F01N 2900/1631; F01N 2240/16; F01N 2900/1404; F01N 3/027; F01N 9/00
See application file for complete search history.

(56) References Cited

U.S. PATENT DOCUMENTS

2012/0034810 A1 2/2012 Chiarelli
2023/0184149 A1* 6/2023 Balenovic ..... F01N 9/005 60/300

FOREIGN PATENT DOCUMENTS

CN 1328361 A 12/2001
CN 102570649 A 7/2012
CN 105098417 A 11/2015
DE 41 32 814 A1 4/1993
(Continued)

*Primary Examiner* — Brandon D Lee
(74) *Attorney, Agent, or Firm* — NORTON ROSE FULBRIGHT US LLP; Gerard A. Messina

(57) ABSTRACT

A method for heating an exhaust system downstream from an internal combustion engine using an electrical heating device. The method includes an ascertainment of a current temperature in the exhaust system, an ascertainment of a current temperature of the electrical heating device and a fluid mass flow flowing through the electrical heating device, an ascertainment of a heating requirement based on the ascertained current temperature and a target temperature, a calculation of a required amount of heat depending on the heating requirement and an amount of energy required to heat up the electrical heating device, taking into account a heat input into the fluid mass flow to be expected at the ascertained current temperature of the electrical heating device, and a control of the electrical heating device to generate the calculated amount of heat. A computing unit and a computer program are also described.

9 Claims, 2 Drawing Sheets

(56) References Cited

FOREIGN PATENT DOCUMENTS

| | | | |
|---|---|---|---|
| DE | 195 04 208 | A1 | 8/1995 |
| DE | 102009032022 | A1 | 1/2011 |
| DE | 102017209568 | A1 | 12/2018 |
| DE | 102019205127 | A1 | 4/2020 |
| DE | 102021208258 | A1 | 2/2023 |
| DE | 102021212923 | A1 | 5/2023 |
| TW | 435060 | B | 5/2001 |

* cited by examiner

METHOD FOR HEATING AN EXHAUST SYSTEM

FIELD

The present invention relates to a method for heating an exhaust system downstream of an internal combustion engine, as well as to a computing unit and to a computer program for carrying out same.

BACKGROUND INFORMATION

Three-way catalysts (TWCs), which enable conversion of the relevant gaseous pollutants NOx, HC and CO into harmless products such as $N_2$, $H_2O$ and $CO_2$, can be used to meet statutory emission limits. For such catalytic reactions to proceed as intended, the temperatures in the catalyst must usually exceed the so-called light-off temperature of typically 300-400° C. As soon as this temperature is reached or exceeded, the catalyst converts the relevant pollutants almost completely (the so-called catalyst window).

In order to achieve this condition as quickly as possible, so-called internal engine catalyst heating measures can be applied. The degree of efficiency of the gasoline engine is thereby worsened by late ignition angles, thus increasing the exhaust gas temperature and the enthalpy input into the catalyst. Adapted injection strategies (e.g., multiple injections) can simultaneously ensure combustion stability.

The constant tightening of existing exhaust gas limits and the regulation of additional pollutant components (e.g., ammonia, $NH_3$) is leading to increasing complexity of exhaust gas aftertreatment systems, which usually consist of a plurality of catalysts connected in series. For reasons of installation space, catalysts in the underbody are thus used in addition to those located close to the engine.

In addition to the above-mentioned internal engine catalyst heating measures, external catalyst heating measures, for example by means of electrically heatable catalysts or exhaust gas burners, can also be used. Such external heating measures are described, for example, in German Patent No. DE 41 32 814 A1 and German Patent Application No. DE 195 04 208 A1. They are particularly suitable for quickly heating up components of the exhaust system that are installed remote from the engine to the required operating temperature, since the internal engine heating measures do not take effect in these locations, or do so only after a long time.

SUMMARY

The present invention relates to a method for heating an exhaust system downstream of an internal combustion engine, as well as to a computing unit and to a computer program for carrying out the method. Advantageous example embodiments of the present invention are disclosed herein.

A method according to an example embodiment of the present invention for heating an exhaust system downstream of an internal combustion engine, e.g., a gasoline or diesel engine or other internal combustion engines such as gas or H-burners, by means of an electric heating device, comprises an ascertainment of a current temperature in the exhaust system, an ascertainment of a current temperature of the electrical heating device and a fluid mass flow rate flowing through the electrical heating device, an ascertainment of a heating demand based on the ascertained current temperature and a target temperature, a calculation of a required amount of heat depending on the heating demand and an amount of energy required to heat the electric heating device, taking into account a heat input into the fluid mass flow to be expected at the ascertained current temperature of the electrical heating device, and a control of the electric heating device to generate the calculated amount of heat. In particular, the fluid mass flow can be an exhaust gas mass flow generated by the internal combustion engine.

Electric heating devices, also referred to below, without restriction to the specific design of the heating device, as heating disks, which are installed in the exhaust system, enable heat to be introduced into the exhaust system by means of electrical energy from the vehicle electrical system independently of the engine conditions and, in particular, when the engine is (still) at a standstill, which heat is transported by means of the engine exhaust gas mass flow or using externally supplied transport air into the components of the exhaust system arranged downstream of the heating disk(s). However, the electric energy consumption leads to a corresponding load on the electrical system and battery of the vehicle. The method according to the present invention makes it possible to minimize energy consumption by requesting and providing the required amount of heat or heating power as precisely as possible. The taking into account of the heat transfer of an already (partially) heated heating device to the fluid mass flow flowing through it, if applicable, lowers the consumption of electrical energy and also leads to a more precise setting of the target temperature.

In particular, the ascertainment of the current temperature in the exhaust system, and/or the heating device, and/or the calculation of the required amount of heat is carried out based on a temperature model of the exhaust system.

According to an example embodiment of the present invention, the use of a model-based (feedforward) control system allows the required heating power to be calculated directly on the basis of physical parameters, for example temperature upstream of and/or in the heating disk, mass flow, mass of the catalyst to be heated, heat capacities, and the like, thereby taking into account all physically relevant influencing parameters. Any additional PID control that may be available as an option only has to correct disturbance variables. Furthermore, a maximum permissible temperature can be defined and conformance thereto can be monitored by means of the temperature model. This allows important components of the exhaust system (e.g., heating disk, catalyst, particulate filter, . . . ) to be protected from detrimental overheating.

The physical equations used in the temperature model to ascertain the heating disk temperature may be inverted in order to directly ascertain the heating power required to reach a given target temperature.

Substantially two superimposed heating processes must be taken into account. One of these is the heating of the mass flow above the heating disk. In addition to the temperature difference, the mass of the gas to be heated and its heat capacity are relevant here. The other is the heating of the heating disk itself. In addition to the temperature difference, the mass and the heat capacity of the heating disk are relevant here:

$$Pwr_{EHC} = dm_{Exh} \cdot c_p \cdot \left(t_{EHC}^{Des} - t_{EHC}^{Uc}\right) + m_{EHC} \cdot c_{p_{EHC}} \cdot \frac{t_{EHC}^{Des} - t_{EHC}}{t_{i_{HeatUp}}}$$

$Pwr_{EHC}$ designates the power of the heating disk, $dm_{Exh}$ the exhaust gas mass flow passing the heating disk, $c_p$ the heat capacity of the exhaust gas mass flow, $t_{EHC}^{Des}$ the target temperature, $t_{EHC}^{Us}$ the temperature of the exhaust gas mass flow upstream of the heating disk, $m_{EHC}$ the mass of the heating disk, $c_{p_{EHC}}$ the heat capacity of the heating disk, $t_{EHC}$ the current temperature of the heating disk, and $t_{i_{HeatUp}}$ a time constant for the heating process.

If an exhaust gas mass flow flows through the (already heated) heating disk, the exhaust gas mass flow will heat up depending on the temperature-dependent and mass-dependent heat transfer coefficient as well as the flowed-against surface, even if no further heating power is requested. In order to set the target temperature of the exhaust gas mass flow, an additional term is therefore required in the feedforward control, which must be subtracted from the raw value of the just-described feedforward control. The additional taking into account of the heat transfer behavior can further reduce the load on the control system: The additional taking into account of the heat transfer behavior from the heating disk into the gas flowing through leads to a further improvement in the model-based feedforward control and a corresponding reduction in the load on the control system.

For example, for heating up an exhaust gas mass flow of 20 kg/h at a temperature of 90° C. to the target temperature of 500° C., theoretically 2.3 kW of electrical heating power is required (according to the above-indicated formula $Pwr_{EHC}=dm_{Exh}\cdot c_p\cdot(t_{EHC}^{Des}-t_{EHC}^{Us})$, wherein in this example, no more energy is required for heating the heating disk itself).

However, since the heating disk temperature in this example is already 500° C., the exhaust gas mass flow will heat up while flowing through the heated heating disk, even without any additional output electrical heating power. In order to prevent the exhaust gas mass flow from overheating, the requested heating power must be reduced by this amount:

$$Pwr_{EHC} = dm_{Exh}\cdot c_p\cdot\left(t_{EHC}^{Des}-t_{EHC}^{Us}\right)-\alpha\cdot A\cdot\left(t_{EHC}-t_{EHC}^{Us}\right)$$

α designates the heat transfer coefficient from the heating disk into the exhaust gas mass flow, and A designates the heat-transferring surface of the heating disk. The heat transfer coefficient depends in particular on the mass flow and increases with increasing mass flow up to a maximum heat transfer coefficient. In the example discussed here, the demand for electrical energy would be approximately −300 W when the heating disk is already at operating temperature.

The time constant $t_{i_{HeatUp}}$ defines the target temporal course of the heating process (e.g., 10 s). It thus offers a degree of freedom for shaping the dynamic heating process by means of corresponding power requirements and can be varied for further fine optimization depending on the deviation between the target and current temperature of the heating disk, along with the exhaust gas mass flow, if applicable.

Further influences such as convective heat transport are taken into account in the temperature model and can optionally also be taken into account in the feedforward control. However, since they are already implicitly included in the heating disk temperature and are of little importance compared with the heating power requirement for heating the mass flow and the heating disk itself, explicit consideration is not required.

Advantageously, according to an example embodiment of the present invention, the method further comprises controlling a fluid flow for transporting heat from the heating device to a component of the exhaust system to be heated, wherein the component to be heated comprises in particular a catalyst and/or a particulate filter. It is particularly advantageous here if the fluid flow for extracting heat from the heating device is controlled when the heating device reaches a predeterminable minimum temperature. This achieves a maximum heating speed of the heating device so that the target temperature is reached very rapidly and heat is only supplied to the component to be heated when the heating device is already hot. In this manner, the degree of efficiency of the heating can be maximized and thus the energy demand can be minimized.

Advantageously, according to an example embodiment of the present invention, the target temperature is ascertained depending on one or more operating parameters of the exhaust system. In particular, the one or more exhaust system operating parameters thereby comprise a pollutant concentration in the exhaust system and/or a pressure drop within the exhaust system and/or an exhaust gas mass flow in the exhaust system and/or an ambient temperature. This allows the appropriate temperature, adapted to the current operating conditions, to be set. For example, an operating temperature of a particulate filter in a normal operation can be lower than an operating temperature during a regeneration of the particulate filter, for which the temperature must be set high enough to burn soot particles.

To ascertain the target temperature, reference can also be made, for example, to the method described in German Patent Application No. DE 10 2021 208 258, in which a method for determining a feature for characterizing the current ability of the catalyst system to convert pollutants is disclosed. Local conversion capacities for portions or partial volumes of the catalyst are determined based on local temperatures, and from this a global or total conversion capacity of the catalyst or the entire exhaust system (with a plurality of individual catalysts) is determined. Specifically, since the catalysts have a certain heat capacity, once the internal combustion engine is started, not all of the catalyst volume will jump into the thermal operating window at the same time. Instead, the exhaust system with the catalysts will heat up in the direction of flow from front to back, thus gradually increasing the convertible catalyst volume over time. This allows the heating power of the heating disk to be adjusted particularly precisely to the actual demand.

As mentioned above, the heating power required to heat both the heating disk itself and the supplied exhaust gas mass flow can be calculated directly by inverting the underlying physical models. Since the main physical influences are taken into account directly, a PID control of the heating disk power can be greatly simplified and, if applicable, eliminated altogether, since only disturbance variables need to be controlled. The dynamic shaping of the heating process can be achieved by corresponding variation of the time constant $t_{i_{HeatUp}}$ depending on the deviation between the target and current temperature of the heating disk, along with the exhaust gas mass flow, if applicable (e.g., small time constant and correspondingly high power demand with a large difference to the target temperature or high mass flow, in order to dynamically promote the heating). In particular, operating changeovers, for example for operation without or with transport air mass flow or a stationary/running engine or cold-start heating, temperature maintenance, particle filter regeneration, etc., can thus be omitted and greatly simplify the functional control logic.

According to an example embodiment of the present invention, the physically modeled heating disk temperatures can also be used directly to limit the maximum allowable heating power (e.g., for component protection). Particularly in real operation with changing boundary conditions, such an approach enables the heating power to be limited in a robust manner and the full potential to be exploited below the limitation. Manufacturer specifications regarding operation with unlimited heating power for a specified period of time can be physically implemented by activating the limitation only from a hysteresis threshold of the current modeled heating disk temperature. Below this threshold, for example, only the nominal heating power, or even the heating power that is slightly increased according to the manufacturer's specification, is limited, which allows the potential of the electric heating disk to be exploited to the maximum.

A computing unit according to the present invention, e.g., a control unit of a motor vehicle, is configured, in particular programmatically, to carry out a method according to the present invention.

Furthermore, the implementation of a method according to the present invention in the form of a computer program or computer program product having program code for carrying out all the method steps is advantageous because it is particularly low-cost, in particular if an executing control unit is also used for further tasks and is therefore present anyway. Finally, a machine-readable storage medium is provided with a computer program as described above stored thereon. Suitable storage media or data carriers for providing the computer program are, in particular, magnetic, optical, and electric storage media, such as hard disks, flash memory, EEPROMs, DVDs, and others. It is also possible to download a program via computer networks (Internet, intranet, etc.). Such a download can be wired or wireless (e.g., via a WLAN network or a 3G, 4G, 5G or 6G connection, etc.).

Further advantages and embodiments of the present invention can be found in the description and the figures.

The present invention is illustrated schematically in the figures on the basis of an embodiment and is described below with reference to the figures.

DETAILED DESCRIPTION OF EXAMPLE EMBODIMENTS

By way of example, the following description describes an embodiment of the present invention based on an exhaust system of a gasoline engine with 3-way catalysts (TWCs) used therein.

However, it should be noted that the proposed method according to the present invention is equally suitable for diesel or other internal combustion engines, e.g., gas or H2 burners. Here, the respective burner-specific catalysts are then used instead of a TWC, e.g., oxidation catalyst, SCR, particulate filter, NSC, etc.

Figure 1:
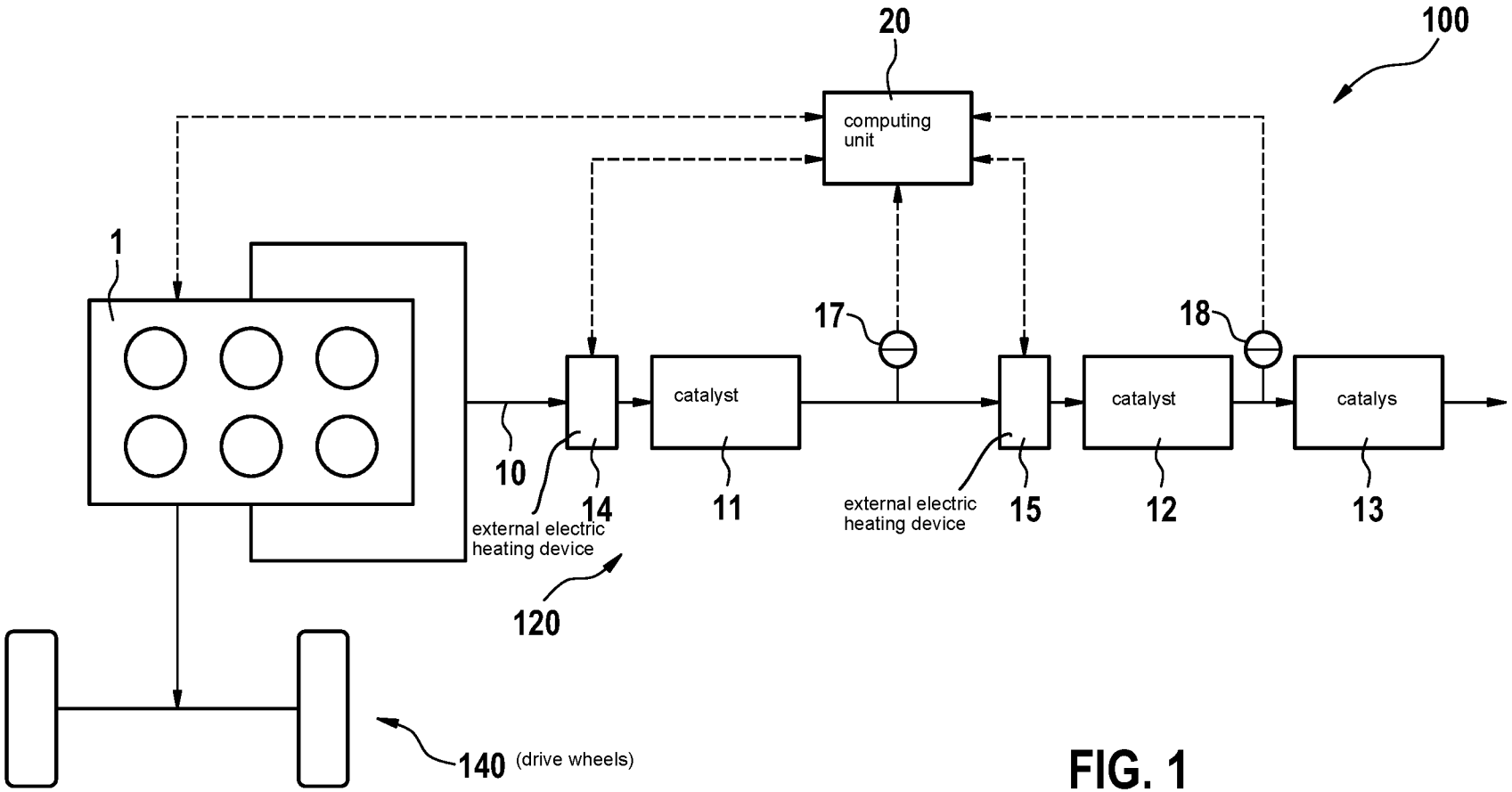
FIG. 1 shows an arrangement with an internal combustion engine and an exhaust system, as may be the basis of the present invention.

In FIG. 1, an arrangement with an exhaust system as can be used within the framework of the present invention, for example a vehicle, is shown schematically and designated overall with the number 100.

The vehicle 100 comprises an internal combustion engine 1 used to drive wheels 140 of the vehicle 100, as well as an exhaust system 120 with a plurality of catalysts 11, 12, 13 arranged downstream of the internal combustion engine 1. In the example shown, sensors 17, 18 are arranged downstream of each of the catalysts 11, 12 and are each connected in a data-conducting manner to a computing unit 20, for example a control unit of the vehicle 100. The sensors can detect operating parameters of the exhaust system 120, such as temperatures, exhaust gas compositions, exhaust gas mass flows or the like. Of course, the positions of the sensors 17, 18 shown should only be understood as examples. Furthermore, the number of sensors is also not limited to the two shown. Rather, more or fewer sensors may also be provided.

In the example shown, the computing unit 20 is further connected in a data-conducting manner to the internal combustion engine 1 and to external electric heating devices 14, 15, each of which is associated with one of the catalysts 11, 12, 13. In particular, the electric heating devices 14, 15 may also be arranged directly in the catalyst or within a housing of the catalyst. It should be noted here that at least one electric heating device is required within the framework of the present invention, but a plurality of electric heating devices, as shown in FIG. 1, can of course be used side-by-side and controlled, for example, in each case analogously to one another. In particular, when a plurality of heating devices is used, each can be operated to account only for the heating requirements of components located directly downstream of it and upstream of the next heating device.

Exhaust gas 10 generated by the internal combustion engine 1 is successively fed to the catalysts 11, 12, 13 in order to be purified or decontaminated in them. Each of the catalysts 11, 12, 13 can be provided for a particular decontamination or for a plurality of simultaneous decontaminations. For example, a first catalyst 11, which can be located close to the internal combustion engine 1, may be a three way catalyst (TWC), while a second catalyst 12 and third catalyst 13 may comprise other catalysts and/or purification components such as NOx storage catalysts, SCR catalysts, particulate filters, or the like. However, the second and third catalysts 12, 13 may also comprise one or more additional TWCs. Furthermore, the first catalyst 11 can also comprise one or more other purification components and does not necessarily have to be in the form of a TWC.

Depending on the type of catalyst, each of the catalysts 11, 12, 13 has a specific thermal working range, also referred to as a conversion window. For effective conversion, a predeterminable minimum temperature, also known as the light-off temperature, must be reached. Above the light-off temperature, a conversion of the various pollutants into less harmful substances takes place. However, if necessary, an increase in effectiveness can still be achieved if the relevant catalyst is operated at a temperature that is higher than the light-off temperature. In such a case, a set temperature is advantageously specified for the relevant catalyst 11, 12, 13. As described at the beginning, a control system can generally also be based on thermally active volume fractions of the cleaning components. However, the present invention will be described here using an example with a temperature-based control system.

Figure 2:
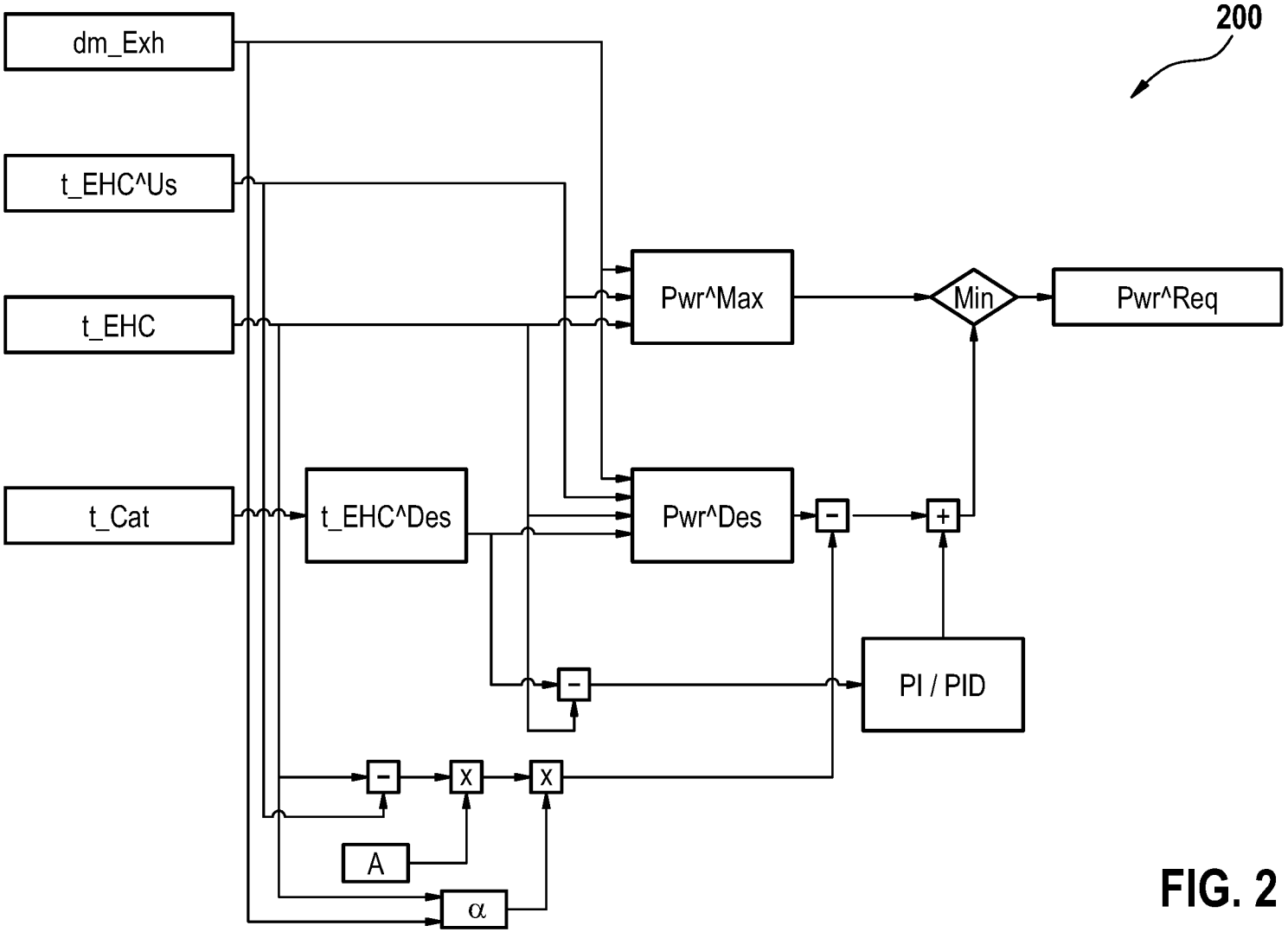
FIG. 2 shows an example embodiment of a method according to the present invention schematically in the form of a simplified flow chart.

In FIG. 2, an advantageous embodiment of a method according to the present invention is shown schematically in the form of a simplified flow chart and designated by the number 200. For the sake of simplicity, only the control system of a single electric heating device 14 is described here; if there is a plurality of heating devices, each can be operated similarly to the method described here.

The method 200 uses as input variables temperatures of catalyst(s), t_Cat, exhaust gas upstream of the electric heating device, t_EHCˆUs, and the heating device, t_EHC, along with an exhaust gas mass flow, dm_Exh. Such input variables can be ascertained based on sensors and/or models.

Based on the current catalyst temperature t_Cat, a target temperature for the exhaust gas leaving the heating disk is calculated in a step t_EHCˆDes. The minimum operating temperature ("light-off temperature") required in the relevant catalyst is taken into account here.

Based on the exhaust gas mass flow dm_Exh, the exhaust gas temperature upstream of the heating disk t_EHCˆUs and the current temperature of the heating disk t_EHC, a maximum permissible heating power for the heating device 14 is ascertained in a step PwrˆMax.

Furthermore, based on the input variables used in the step PwrˆMax and the target temperature ascertained in the step t_EHCˆDes, a heating power desired to achieve the target temperature as efficiently as possible is ascertained in a step PwrˆDes.

The desired heating power is compared with the maximum permissible heating power in a step Min. The smaller of the two ascertained heating powers is then output as the heating power requirement and the heating disk is controlled according to the heating power requirement. For this purpose, a corresponding electrical power is supplied to the heating disk from a vehicle electric system of the vehicle 100.

Before the comparative or minimum step Min is carried out, the desired heating power PwrˆDes is reduced by the amount which results from the heat transfer from the heating disk to the exhaust gas mass flow flowing toward it under the current operating parameters. For this purpose, a temperature difference between the exhaust gas upstream from the heating disk (t_EHCˆUs) and the heating disk itself (t_EHC) is ascertained (link "–" in FIG. 2) and multiplied by the heat transfer surface of the heating disk A and the heat transfer coefficient $\alpha$, which depends on the heating disk temperature t_EHC and the exhaust gas mass flow dm_Exh (links "x" in FIG. 2). The correction value obtained in this manner is subtracted from the value of the desired heating power ascertained as explained above (link "–" in FIG. 2) to obtain a corrected desired heating power.

Optionally, the corrected desired heating power as ascertained in the step PwrˆDes can be further corrected (link "+" in FIG. 2) before carrying out the comparison step Min by means of a controller value, which is ascertained in a step PI/PID based on a difference (link "–" in FIG. 2) between the target temperature and the current temperature of the heating disk t_EHC. However, this is not absolutely necessary due to the already very precise and robust temperature control, since, in the step PI/PID, only disturbance variables with a relatively small influence on the final exhaust gas temperature downstream of the heating disk 14 are compensated for.

It should be emphasized that the method 200 cannot be carried out exclusively with exhaust gas as the heat transfer fluid; rather, externally conveyed fluids, in particular air, can also be used. This is particularly advantageous in situations in which no exhaust gas mass flow is (yet) available, for example in situations in which the vehicle 100 is stationary and/or the internal combustion engine 1 is not being operated (e.g., prior to a departure, during electrically driven travel in hybrid vehicles, . . . ).

The method 200 has been described here with a focus on the heating of the catalysts in a cold start and keeping the catalysts warm during further operation. However, the method 200 can also be transferred to further areas, such as supporting particulate filter regeneration or NOx catalyst regeneration. Furthermore, to increase the emission robustness, the method 200 can advantageously also be used outside of catalyst heating or regeneration requirements in so-called normal operation to keep the downstream catalyst at a lower base temperature if applicable. If necessary, separate heating pane setpoints (target temperatures) can be defined for fine optimization in a such normal or regeneration mode.

The invention claimed is:

1. A method for heating an exhaust system downstream of an internal combustion engine using an electric heating device, comprising the following steps:

ascertaining a current temperature in the exhaust system;

ascertaining a current temperature of the electrical heating device and a fluid mass flow flowing through the electrical heating device;

ascertaining a heating requirement based on the ascertained current temperature in the exhaust system and a target temperature, calculating a required amount of heat depending on the heating requirement and an amount of energy required for heating the electrical heating device, taking into account a heat input into the fluid mass flow to be expected at the ascertained current temperature of the electrical heating device; and controlling the electric heating device to generate the calculated amount of heat.

2. The method according to claim 1, wherein: (i) the ascertainment of the current temperature in the exhaust system and/or the heating device, and/or (ii) the calculation of the required amount of heat is carried out based on a temperature model of the exhaust system.

3. The method according to claim 1, further comprising:

controlling a fluid flow for transporting heat from the heating device to a component of the exhaust system to be heated.

4. The method according to claim 3, wherein the component to be heated includes a catalyst and/or a particulate filter.

5. The method according to claim 3, wherein the fluid flow for transporting the heat from the heating device is controlled when the heating device reaches a predeterminable minimum temperature.

6. The method according to claim 1, wherein the target temperature is ascertained depending on one or more operating parameters of the exhaust system.

7. The method according to claim 6, wherein the one or more operating parameters of the exhaust system include a pollutant concentration in the exhaust system and/or a pressure drop within the exhaust system and/or the fluid mass flow in the exhaust system and/or an ambient temperature.

8. A computing unit configured to heat an exhaust system downstream of an internal combustion engine using an electric heating device, the computing unit configured to:

ascertain a current temperature in the exhaust system;

ascertain a current temperature of the electrical heating device and a fluid mass flow flowing through the electrical heating device;

ascertain a heating requirement based on the ascertained current temperature in the exhaust system and a target temperature, calculate a required amount of heat depending on the heating requirement and an amount of energy required for heating the electrical heating device, taking into account a heat input into the fluid mass flow to be expected at the ascertained current temperature of the electrical heating device; and control the electric heating device to generate the calculated amount of heat.

9. A non-transitory machine-readable storage medium on which is stored a computer program for heating an exhaust system downstream of an internal combustion engine using an electric heating device, the computer program, when executed by a computer, causing the computer to perform the following steps:

ascertaining a current temperature in the exhaust system;

ascertaining a current temperature of the electrical heating device and a fluid mass flow flowing through the electrical heating device;

ascertaining a heating requirement based on the ascertained current temperature in the exhaust system and a target temperature, calculating a required amount of heat depending on the heating requirement and an amount of energy required for heating the electrical heating device, taking into account a heat input into the fluid mass flow to be expected at the ascertained current temperature of the electrical heating device; and controlling the electric heating device to generate the calculated amount of heat.

* * * * *